US006955068B2

(12) United States Patent
Gelardi

(10) Patent No.: US 6,955,068 B2
(45) Date of Patent: Oct. 18, 2005

(54) MEDIA DISC PACKAGE WITH RETAIL SECURITY LOCK

(75) Inventor: John A. Gelardi, Kennebunkport, ME (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/189,815

(22) Filed: Jul. 6, 2002

(65) Prior Publication Data

US 2003/0052023 A1 Mar. 20, 2003

Related U.S. Application Data

(60) Provisional application No. 60/303,060, filed on Jul. 6, 2001.

(51) Int. Cl.[7] ..... E05B 69/00

(52) U.S. Cl. ..... 70/58; 70/57.1; 206/1.5; 206/308.2; 206/387.11

(58) Field of Search ..... 70/57.1, 58, 63; 206/1.5, 308.2, 387.11

(56) References Cited

U.S. PATENT DOCUMENTS

| | | | | | |
|---|---|---|---|---|---|
| 3,514,981 | A | * | 6/1970 | Esquibel et al. | 70/63 X |
| 3,995,900 | A | * | 12/1976 | Humble et al. | 292/316 |
| 4,084,690 | A | * | 4/1978 | Pulse | 206/1.5 X |
| 4,658,955 | A | * | 4/1987 | Eichner | 206/307 |
| 4,850,477 | A | * | 7/1989 | Gelardi et al. | 206/387 X |
| 5,375,712 | A | * | 12/1994 | Weisburn | 206/1.5 X |
| 5,402,882 | A | | 4/1995 | Bandy | |
| 5,417,319 | A | * | 5/1995 | Chalberg et al. | 206/1.5 |
| 5,566,828 | A | * | 10/1996 | Claes et al. | 70/63 X |
| 5,713,464 | A | * | 2/1998 | Chang | 206/308.1 |
| 5,799,782 | A | * | 9/1998 | Gelardi | 206/308.1 |
| 5,819,928 | A | * | 10/1998 | Wynalda, Jr. | 206/308.1 |
| 5,823,341 | A | * | 10/1998 | Nakasuji | 206/387.11 |
| 5,904,246 | A | | 5/1999 | McGill | |
| 5,906,274 | A | * | 5/1999 | McEwan | 206/308.1 |
| 5,931,291 | A | * | 8/1999 | Sedon et al. | 206/1.5 |
| 5,944,185 | A | * | 8/1999 | Burdett et al. | 206/387.11 |
| 6,443,300 | B1 | * | 9/2002 | Gelardi | 206/312 |
| 6,516,639 | B1 | * | 2/2003 | Margetts et al. | 70/57.1 |
| 6,516,945 | B2 | * | 2/2003 | Myszka et al. | 206/308.2 |
| 6,601,415 | B2 | * | 8/2003 | Takinami | 70/57.1 |
| 6,694,782 | B2 | * | 2/2004 | Mitsuyama | 70/57.1 |
| 2001/0052251 | A1 | * | 12/2001 | Mitsuyama | 70/57.1 |
| 2002/0194888 | A1 | * | 12/2002 | Mitsuyama | 70/57.1 |
| 2003/0094021 | A1 | * | 5/2003 | Takinami | 70/57.1 |

FOREIGN PATENT DOCUMENTS

| | | | |
|---|---|---|---|
| FR | 2785439 | A | 5/2000 |

* cited by examiner

*Primary Examiner*—Suzanne Dino Barrett
(74) *Attorney, Agent, or Firm*—Stuart J. Friedman

(57) ABSTRACT

Media disk packages having a retail security lock feature. The lock feature comprises a locking dagger having a head portion and a dagger section, which is engageable with an inner disk tray that overlays the media disk within the package. The package may house multiple disks.

21 Claims, 12 Drawing Sheets

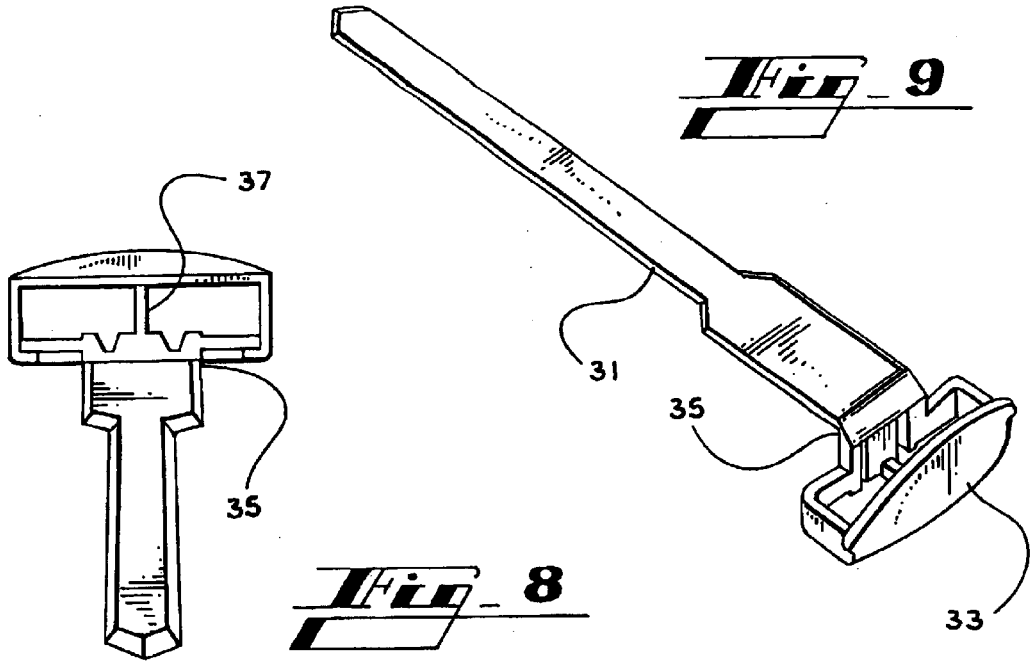
Fig. 9
Fig. 8
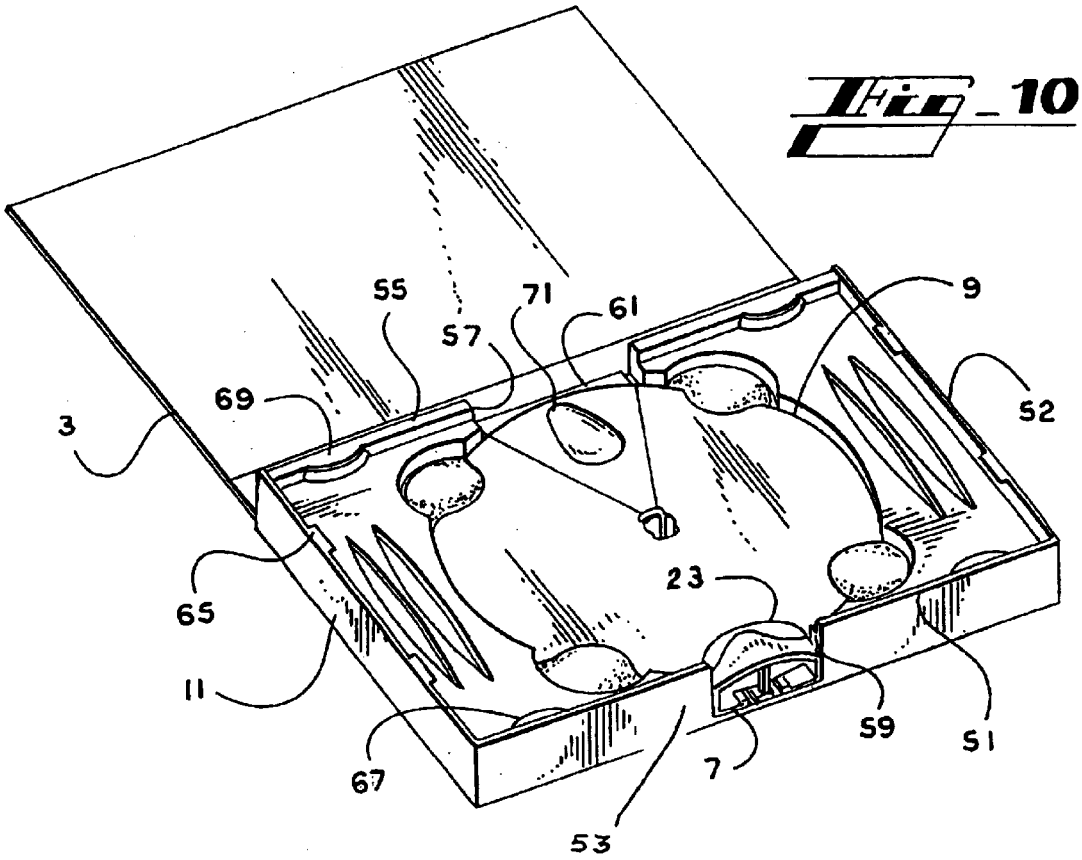
Fig. 10

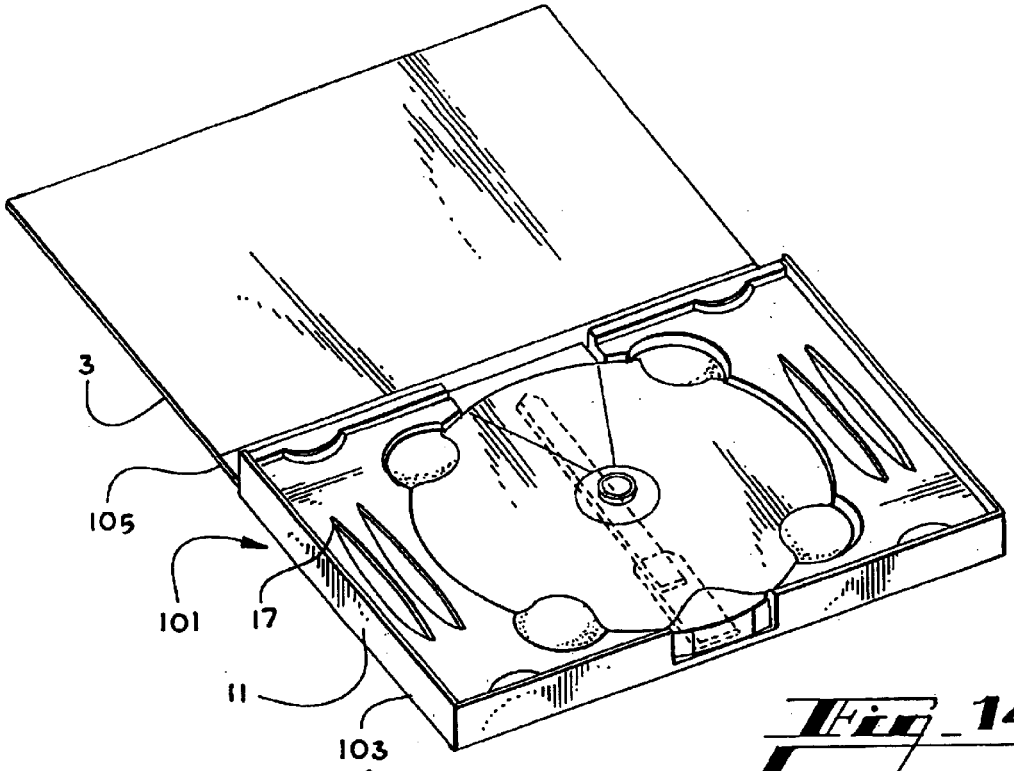
Fig_14
Fig_15
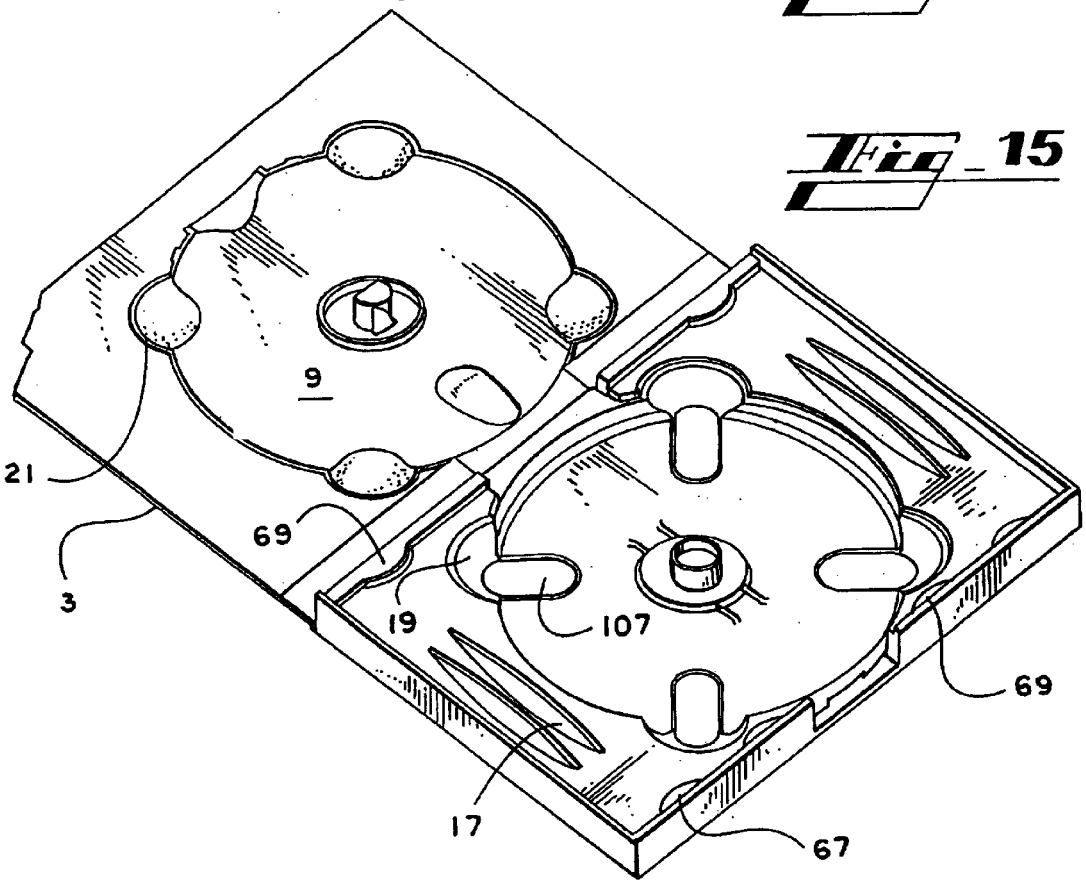

MEDIA DISC PACKAGE WITH RETAIL SECURITY LOCK

This application claims priority of U.S. Provisional Application No. 60/303,060, filed Jul. 6, 2001, the entire disclosure of which is herein incorporated by reference.

TECHNICAL BACKGROUND AND FIELD OF INDUSTRIAL APPLICABILITY

The invention relates to a form of secure packaging for information storage media, also known as optical discs, whether in compact disc (CD) or digital video disc (DVD) format. The packaging includes a lock feature that is housed within the packaging, and which prevents removal of the disc media.

BACKGROUND OF THE INVENTION

Prevention of theft of information storage media such as CDs and DVDs is a significant retailing problem. In conventional media disc packaging, such inventory losses occur because the media disc may be slipped out of conventional packaging, e.g. jewel case packaging, by distorting the package enough to dislodge the disc from a center hub upon which it is mounted and create an opening between the covers of the package. The disc may then be unobtrusively slipped out of the package. There is a well recognized need for packaging that will prevent this type of theft, and which will secure the disc media to prevent slippage while it is housed within its packaging. These needs are addressed by the packaging and security locking features of the present invention.

SUMMARY OF THE INVENTION

The invention is a storage-display packaging case for multiple discs, typically from about 1 to 4, which incorporates a security device that allows retail customers access to internal graphics and booklets, but does not permit removal of the discs. The security device comprises as elements a locking dagger, and an inner disc cover attached to a tray for holding the media article, with which the locking dagger is engaged and disengaged to lock and open the package.

In one aspect, the packaging case comprises a case in which is accommodated a molded plastic tray having an integral hinged inner disc cover attached thereto. The inner disc cover might also be separately formed and securely attached by means other than being integrally formed with the tray part. The bottom of the tray is attached to an outer cover, spine, and back cover panel formed of a single piece of sheet material. Conventionally, the tray may be formed with a rosette that serves as a mounting hub for the discs. The inner and outer faces of the cover, spine and back panel may be printed with graphics or text, and may further incorporate decorative techniques such as three-dimensional (e.g. holographic, lenticular) printing. In this respect also, the use of a single piece of sheet material should not be interpreted as limiting, as any combination of the outer cover, spine and back cover panel elements are within the scope of the invention.

The inner disc cover is positively locked shut by a locking dagger comprising a dagger section that passes through an inner disc cover extension fitted within the disc rosette boss of the molded tray. The locking element comprises a dagger section, which is preferably connected to a head portion by means of a living hinge. Preferably, it may also comprise a tab having one or more locking snaps, preferably a pair, on a surface thereof for engaging the inner disc cover. The head portion is additionally fitted with one or more locking straps therein, which are preferably positioned longitudinally within the head portion. The inner disc cover may be released by snipping a locking strap in the head portion. This allows the head portion to deflect and release two locking snaps (teeth) that engage two holes in the inner (tray) cover and a locking snap which engages a hole in a forward tray extension. When the lock-strap dagger section is removed, the inner disc cover can be opened. The molded tray has tabs for holding a booklet, finger wells for insertion and removal of the discs, one or more disc display/organizer slots and additional tabs for holding the outer cover closed.

A media security retail package according to the invention contains one to four discs in the tray, which is covered with an inner disc cover. During retail the inner disc cover is locked in place with a security tag or locking dagger. The locking dagger engages a protrusion on the inner disc cover and locks the cover while the dagger is held in place. Cutting a rib on the locking dagger allows it to be deflected or rotated and so disengaged from the cover. The locking dagger can then be removed to release the cover.

The tray and inner disc cover are molded in one piece. The inner disc cover is attached to the rear edge of the tray, preferably, by a living hinge. The inner disc cover, in one embodiment, has a disc-like shape and finger well cover extensions which extend radially from the shape to cover finger wells in the tray. The inner disc cover may also be configured in various shapes to cover only a portion of the discs held therebeneath, or to extend beyond the periphery of the discs to a size less than or equal to the perimeter of the outer cover. The tray has a central raised boss for fitting within central openings in the discs. An extension on the inner disc cover fits within the central opening in the boss. The extension is preferably formed as a perpendicular extension from the inner disc cover which protrudes downwards when the inner disc cover is closed. In such an embodiment, the extension has lateral walls and a bridge portion which extends between the lateral walls remote from the cover. When the cover is closed on the tray, the bridge portion is aligned with a bottom of the tray. The dagger section of the locking dagger is configured to fit between the sidewalls of the cover extension and over the bridge portion, and so hold the inner disc cover in the locked position until the locking dagger is withdrawn. In this manner, the dagger section is engaged beneath the inner disc cover, and preferably beneath one or more of the media discs. Preferably, the dagger section engages the extension beneath the lowermost disc, near the surface of the tray.

The cover of the storage-display package is made of sheet material, and it is fastened to the base of the tray. Any sheet material is suitable. The cover may be printed with graphics on both surfaces. The graphics on the cover which is attached to the bottom of the tray is visible through the transparent tray. In this respect, the inner surface of the cover is available for viewing the graphics by opening the cover while the locking dagger holds the inner disc cover and prevents withdrawal of the discs from the tray. The outer cover may comprise extensions that fold into the packaging interior as additional panels, or extend beyond the periphery of the tray to provide additional external surface area.

In a foreseeable environment in which the package of the invention may be used, once the package has been inspected, a retail customer purchases the package. Then a retail clerk or the customer cuts a rib on the locking dagger. The tab of the head portion may then be bent along the forward end of the dagger to release inner teeth on the tab from holes in an extension of the inner disc cover. The entire locking dagger may then be withdrawn from the package. The withdrawal of the locking dagger releases the extension on the inner disc cover so that the inner disc cover maybe lifted to provide access to the one or more discs stored in the cavity of the tray.

Once the locking dagger has been withdrawn, it is thrown away. Use of the packaging case by the customer simply requires opening of the outer cover and opening of the inner disc cover for providing access to the discs held in the tray cavity. The discs may be temporarily stored in grooves formed into the surface of the tray. After removing the discs the inner disc cover may be closed to prevent entry of dust into the cavity. To replace the discs in the cavity the inner disc cover is opened. The discs are inserted in the cavity, and the inner disc cover is closed. The outer cover is then closed, and forward edges of the outer cover are placed under inward extending tabs on the upper edges of the tray rim to keep the package closed. When opening and closing the covers, both covers may be moved at one time by lifting the inner disc cover and lowering the outer cover. The extension of the inner disc cover is positioned in an opening in the front wall of the tray for easy finger or thumb access. The outer cover is closed simply by pressing downward and then forward on the cover.

The package is preferably formed in three parts, for example in an injection molding process, although any other method of forming parts from a plastic material may be used. In such an embodiment where three separate parts are formed, the molded tray and inner disc cover are formed as a single part. With respect to the locking dagger, the head portion, including the lock tab, and the dagger section are formed as another part. Another part, the outer cover, is formed of sheet material having three sections that are printed on both opposite faces. If desired, as an alternative the outer cover and the tray and inner disc cover might be formed together as a single part. During assembly of the various parts, the lower base portion of the cover is secured to the bottom of the tray. A spine portion of the cover overlies the rear surface of the tray, and the cover portion of the sheet material overlies the top of the tray and the inner disc cover.

When completing the package, the base of the sheet material is mechanically attached, glued or bonded to the base of the tray. The discs are then placed in the cavity of the tray. The inner disc cover and the outer cover are closed, with the forward edge of the outer cover inserted beneath the inward extending tabs on the front rim of the tray.

Alternatively the discs may first be loaded in the transparent tray, and the inner disc cover may be closed over the discs. The locking dagger may be installed into the tray and over the bridge on the extension from the inner disc cover. The locking dagger is anchored in place by engaging inward extending teeth on the tab with openings in the forward extensions of the inner disc cover and of the tray base. Then the base of the tray is mechanically secured, glued or bonded to the preprinted sheet material. The spine and cover portions of the sheet material may be folded over the back and top of the tray, and the forward edge of the cover may be inserted under the tabs in the front rim of the tray, completing the package.

Booklets may be inserted within the rim of the tray above the inner disc cover. The booklets are held under inward extending tabs on the upper edges of the tray rim. The inner disc cover is hinged to the back of the tray at a position below the top of the rim so that the inner disc cover is flush with the upper surface of the tray when the inner disc cover is in the closed position. The outer cover may be held under inward extending tabs at the upper edges of the front and lateral rims.

The outer cover is easily lifted to provide access to the graphics on the inner surface of the outer cover, to show the discs that exist in the cavity and to provide access to booklets held under tabs within the rim of the tray. Opening the outer cover simply requires pushing rearward on the forward edge of the outer cover in the central space between the rims on the forward edge of the tray. That presses the forward edge of the outer cover rearward and releases the forward edge of the outer cover from the inward extending tabs on the forward rim of the tray. Lifting that edge of the cover warps the cover and removes the side edges of the cover from laterally inward extending tabs on the lateral rims of the tray. After the booklet and inside cover graphics have been removed and studied, the booklet is returned beneath the tabs, and the outer cover is closed. Pressing inward in the general region of the middle of the cover restores the edges of the cover to beneath laterally inward extending tabs on the rim. Pressing forward on the cover restores the forward edge of the cover to beneath the inward extending tabs on the forward rim of the tray.

These and further and other objects and features of the invention are apparent in the disclosure, which includes the above and ongoing written specification, with the claims and the drawings.

BRIEF DESCRIPTION OF THE DRAWINGS

FIG. 8 is an end of view of the security lock.

FIG. 9 is a top view of the security lock, wherein the head portion has been deflected to release the inner disc cover.

FIG. 10 is a perspective view of the box with the outer cover opened and the security device in place with the tab locking the inner disc cover.

FIG. 14 shows elements of the box.

FIG. 15 shows elements of the box with the inner disc cover open.

FIG. 20 also shows removing the security tab.

DETAILED DESCRIPTION OF THE PREFERRED EMBODIMENTS

Figure 1:
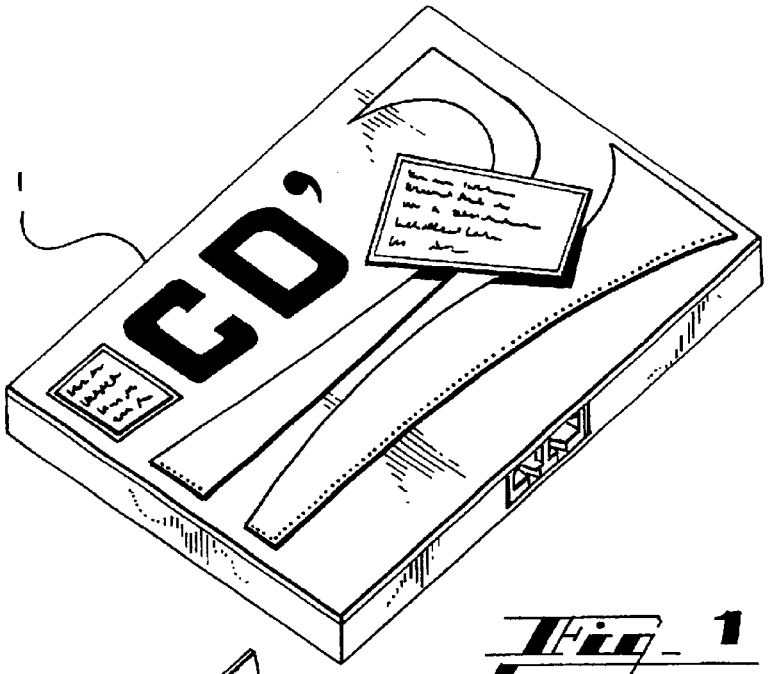
FIG. 1 is a detail of the disc box showing the box closed.
Figure 2:
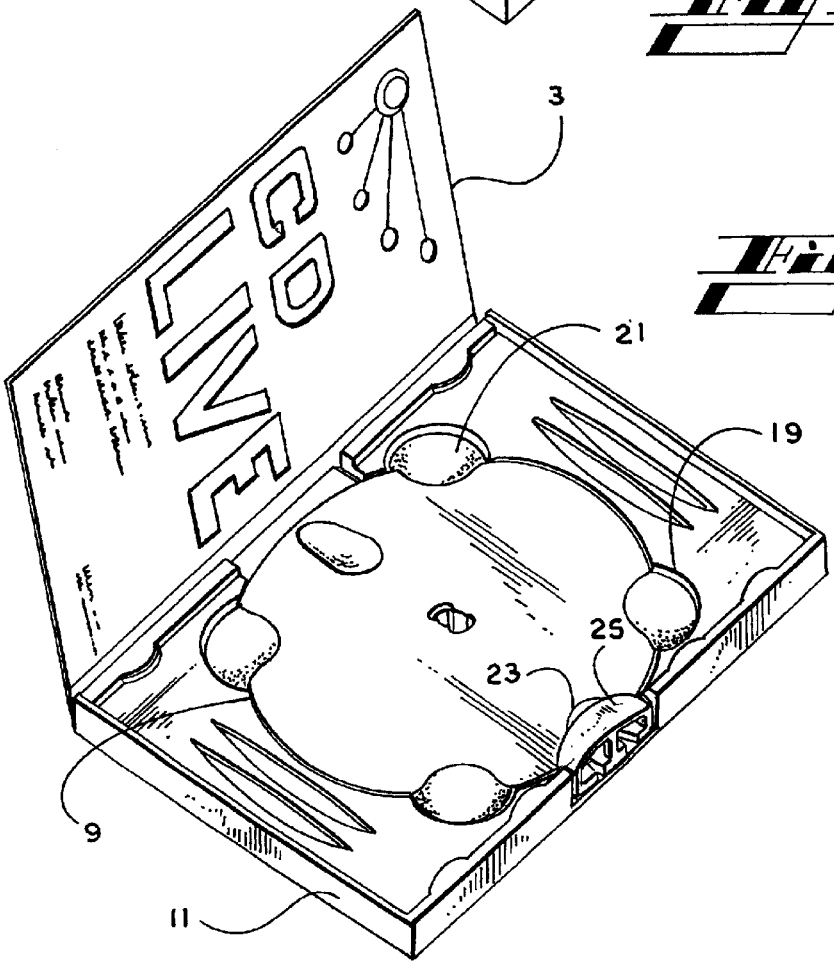
FIG. 2 is a detail of the box showing the outer cover open.

Referring to FIG. 1, a locking security disc retail package is generally indicated by the numeral 1. As shown in FIG. 2, the outer cover 3 of the package may be raised to show graphics on the inside surface of the outer cover and to reveal the presence of discs 5 within the package without releasing the discs for removal. Shown in FIG. 3 is a package which has a security lock 7 partially removed to allow raising the inner disc cover 9 for access to the discs in the tray 11.

Figure 3:
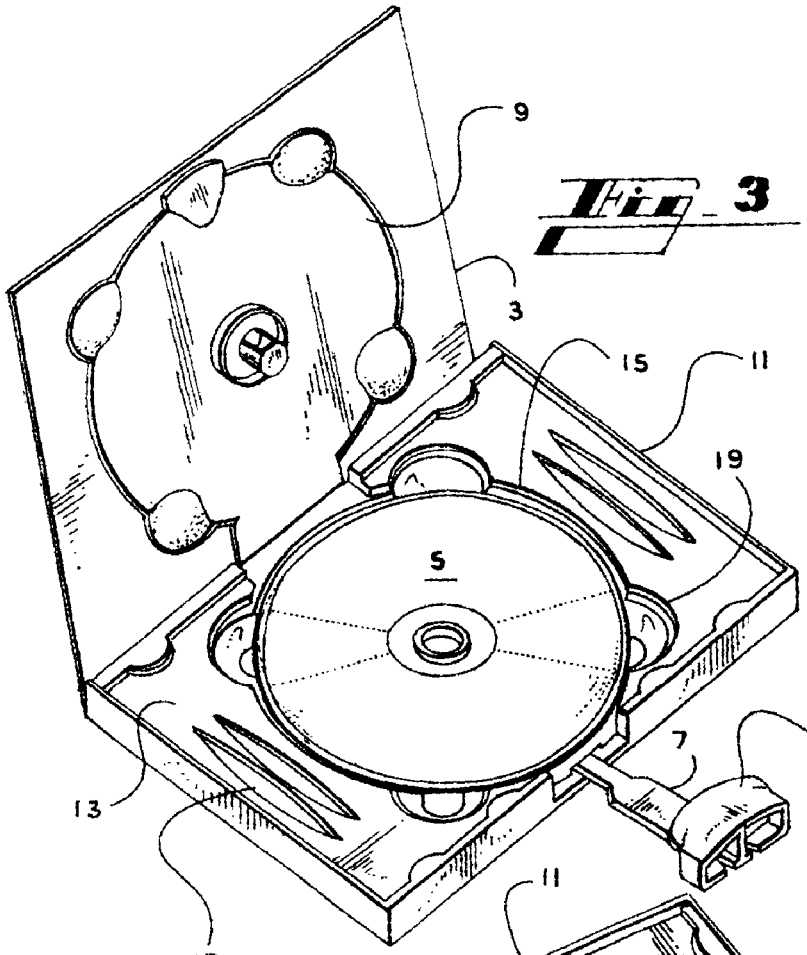
FIG. 3 is a detail of a box showing the locking dagger pulled out and the inner disc cover open.

As shown in FIG. 3, the tray has a flat upper surface 13 with a central well or cavity 15 which holds from one to four discs. The flat upper surface 13 has grooves 17 which hold edges of discs after they have been removed from the tray for storing the discs vertically for ready access. The well or cavity 15 of the tray has finger holes 19 for grasping peripheral edges of the discs and removing the discs from the cavity 15.

The inner disc cover 9 has extensions 21 which cover the finger holes 19 to prevent access to the finger holes for attempting to lift the discs while the inner disc cover is closed and to prevent ingress of dust into the cavity 15 and the discs stored therein. The inner disc cover 9 also has a forward extension 23 at a peripheral edge thereof, which is used to lift the inner disc cover. The forward extension 23 of the inner disc cover 9 has two openings 95 (see FIG. 13) which engage inward extending teeth on the tab 25 of the lock 7 to prevent the lock from being withdrawn from the case until the lock is intentionally disabled.

Figure 4:
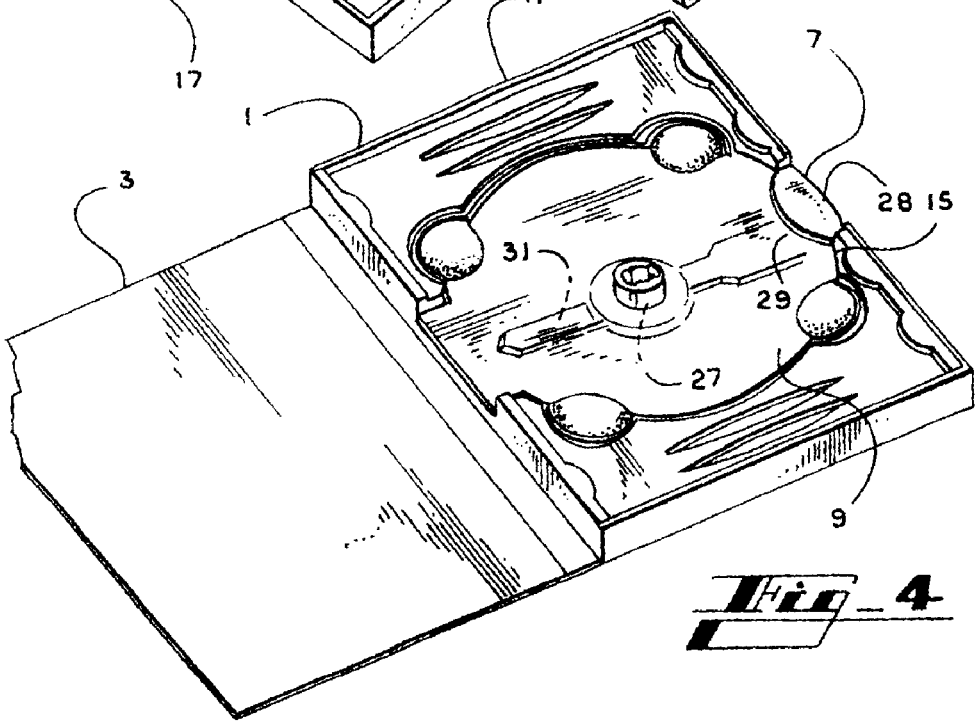
FIG. 4 is a perspective view of the box showing the locking dagger in place and the security tab lock on top of the inner disc cover.
Figure 5:
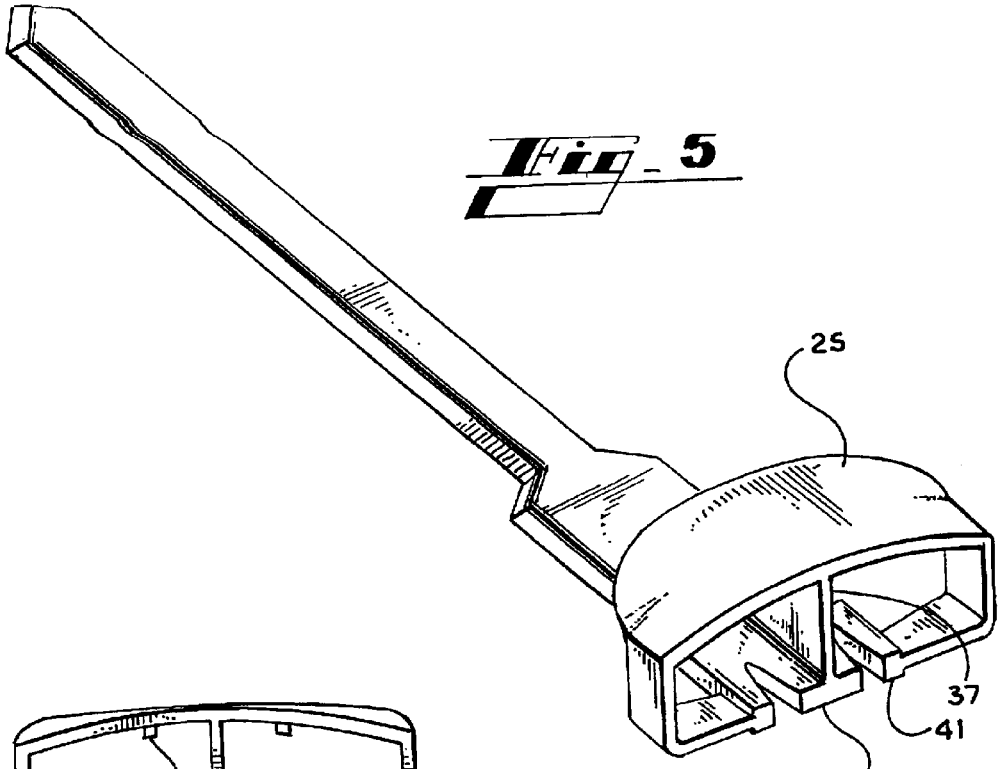
FIG. 5 is a perspective detail of the security lock.
Figure 6:
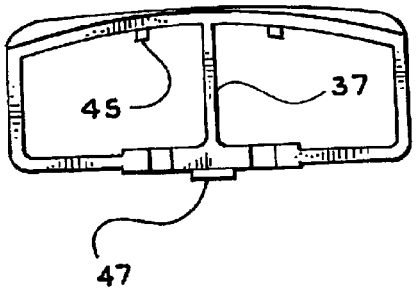
FIG. 6 is a front view of the security lock.
Figure 7:
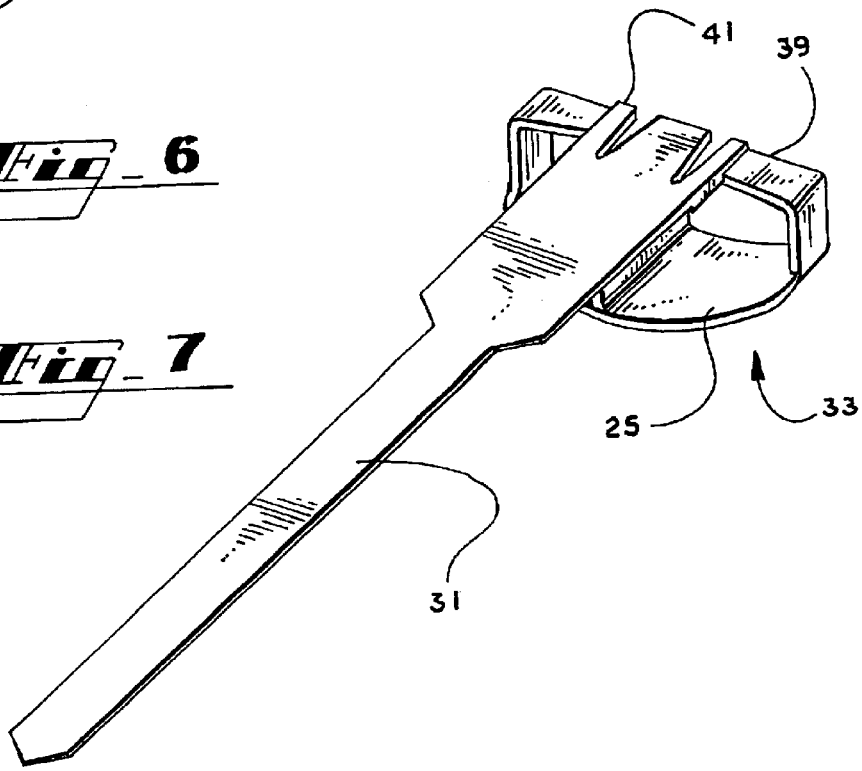
FIG. 7 is a bottom of view of the security lock.

As shown in FIG. 4 the security lock extends through the tray beneath the cavity 15 and through an extension 27 from the inner disc cover 9. The outer cover 3 may be opened while the inner disc cover is held securely locked. The security tab 28 is shown over the forward extension 29 of the inner disc cover, and the dagger section 31 of the security lock is positioned beneath the cavity 15 in the tray 11.

Graphics are provided on both surfaces of the cover panel and on the inner and outer surfaces of the back panel. The tray in this preferred embodiment is made of clear plastic to allow reading of the graphics on the inner surface of the back panel, and the security lock is made of a contrasting material to show that the security lock is in place.

FIGS. 5–9 show the lock 7. A head portion 33 is connected to a front end of the dagger section 31 by a living hinge 35. Rib 37 and forward extensions 39 of the base 41 of the head prevent rotation of the head 33 about the living hinge until the central rib 37 is cut. Teeth 45 under the tab 25 engage openings 95 in the forward extension of the inner disc cover. Tooth 47 engages an opening in the forward extension of the tray base.

FIG. 10 shows the new package 1 in which the outer cover 3 has been opened and the inner disc cover 9 remains closed and locked by the security lock 7. The tray base 11 has rims 51 extending along lateral 52, forward 53 and rearward 55 edges. The opening 57 between the rims at the rearward edge allows the joining of the inner disc cover 9 to the tray 11 by a living hinge 61. The forward rim of the tray base has opening 59 which provides access for a forward extension 23 from the inner disc cover 9.

Inward extending tabs 65 on the lateral rims hold the outer cover closed. The lateral tabs may be located in two or four places. Inward extending tabs 67 at the upper edges of the forward rims also hold the outer cover closed. Tabs 69 along the rearward rim extend inward to hold a booklet in position on the upper surface of the tray and the upper surface of the closed inner disc cover 9. The inner disc cover 9 is reinforced in this embodiment in a triangular area to strengthen the cover and to insure that the cover is not easily removed from the living hinge. A depression 71 is formed in the triangular area of the inner disc cover.

Figure 11A:
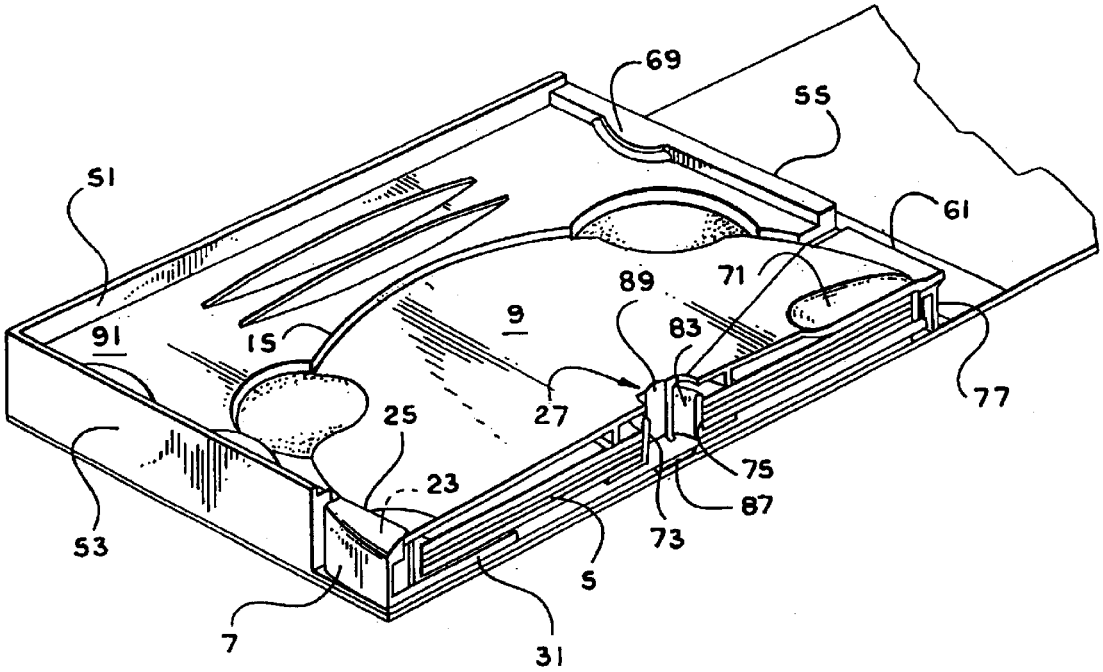
FIG. 11A is a cross sectional view of the box with the tab in place to secure the inner disc cover.

As shown in the front-to-back cross section of the tray 11, discs 5 and sheet material panels in FIG. 11A, the inner disc cover 9 covers the cavity 15 which holds up to four discs in the common disc well. A central boss 73 extends upward from the tray base to secure inner openings 75 of the discs 5. The inner disc cover is joined by a living hinge to the rear wall 77.

The inner disc cover 9 has a central extension 27 which extends downward through the central opening 83 in the central boss 73 of the tray 11. In the locked positions the dagger portion 31 of the lock 7 extends through the openings 85 in the front and back of the extension and over a bridge which connects the lateral walls of the extension for holding the cover in the closed position. At the same time the tab at the front of the security lock holds the front extension of the inner disc cover.

The rims extend upward from the flat surface 91 of the tray 11. As shown in FIG. 11A, the front and rear rims have inward extending tabs at the upper edges of the rims. The rear rim is shorter than the front rim and the side rims. The outer cover when closed fits inside the front and side rims and lies over the rear rim. The rear rim has an inward extending tab 69 which holds a booklet on top of the inner surface 91 of the tray and the upper surface of the closed inner disc cover 9 which is flush with the flat inner surface of the tray. The inner disc cover keeps the discs locked onto the boss for normal storage. The dagger section and tab keeps the discs locked on to the boss for retail display usage. The booklet goes over the discs and inner disc cover. This construction allows the user to open the package after cutting a rib on the front of the security lock but keeps the discs secure in the disc well when the package is used at retail.

Figure 11B:
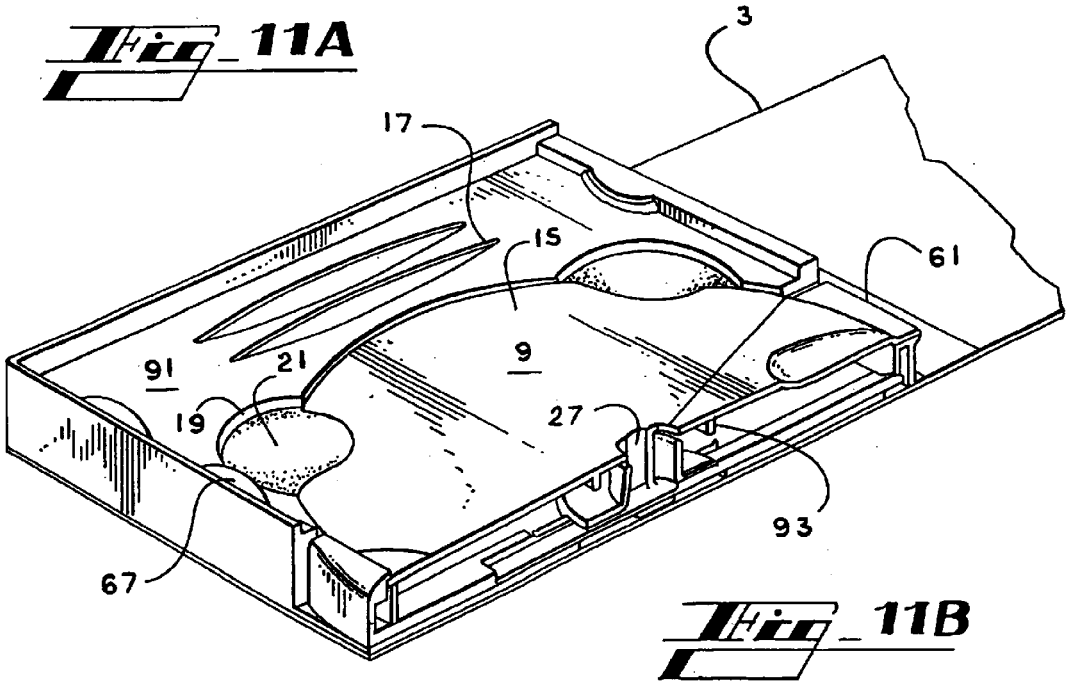
FIG. 11B is a cross sectional view showing the inner disc cover in place and held closed by the locking dagger.

FIG. 11B shows the same cross sectional view as shown in FIG. 11A. The depression on the inner disc cover or disc door and the living hinge triangular area protect against bending except at the living hinge. The triangular area reinforces the disc door. The center of the disc door 9 near the central extension 27 has a circular rim 93 which extends around the central extension. The circular rim engages the uppermost disc to prevent movement of the discs.

Figures 12, 13:
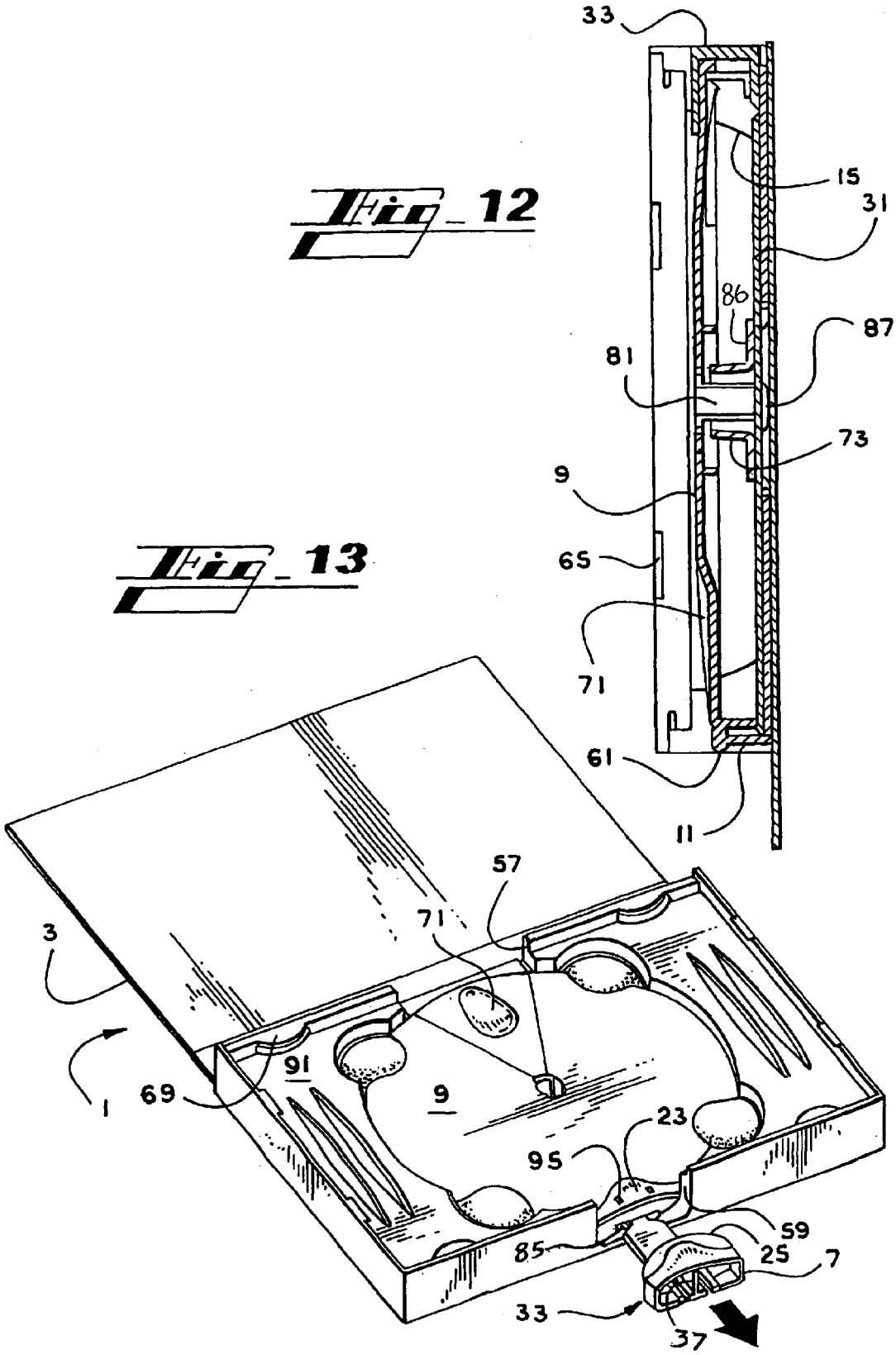
FIG. 12 is a cross sectional view showing the relationship of the locking dagger and the inner disc cover and the tray.
FIG. 13 is a cross sectional view of the box with the outer cover open and the inner disc cover released by opening the locking strap.

FIG. 12 shows a similar cross sectional view. In FIG. 12 the discs are omitted for clarity. The boss 73 is shown attached to and integrally molded upon the tray base. The boss has radial extensions 86 near its base to overlie the lock when the dagger section 31 is in place. The dagger section overlies the tray base and overlies the bridge portion 87 of the extension from the cover or discs door.

FIG. 13 shows the package 1 in which the central rib 37 of the head section 33 has been cut to allow the head section to rotate with respect to the dagger strap section 31. The lock 7 is shown partially withdrawn from the tray. The forward extension 23 of the inner disc cover or disc door 9 has two openings 95 which engage the teeth 45 on the lower side of the head tab when the package is in the locked condition. The holes and the teeth prevent the lock from moving outward in the direction of the arrow. The central rib 37 in the head section 33 prevents the head from being rotated to disengage the teeth 45 from the openings 95 until the rib 37 is cut. The tab section of the head 33 and the forward extension of the inner disc cover 9 are sufficiently flexible to allow the teeth to override the forward extension when the package is being manufactured and the lock is being inserted to secure the inner disc cover. The teeth are sloped at rearward surfaces to encourage the snapping into the locked position.

FIG. 14 schematically shows the cover attachment on the tray. The sheet material 101 has three sections, the base 103 which is attached to the tray 11, the spine 105 which overlies the back of the tray and the cover 3 which overlies the top of the tray. The grooves are provided in the upper surface of the tray as an organizer feature for disc display.

FIG. 15 shows the assembled tray and sheet material before the discs have been inserted. The finger wells have inward extending depressions 107 to aid in removing the bottom disc. Tabs 69 are shown extended inward from both the front and rear rims. The booklet tabs on the front rim are lower than the cover retainer tabs 67.

Figure 16:
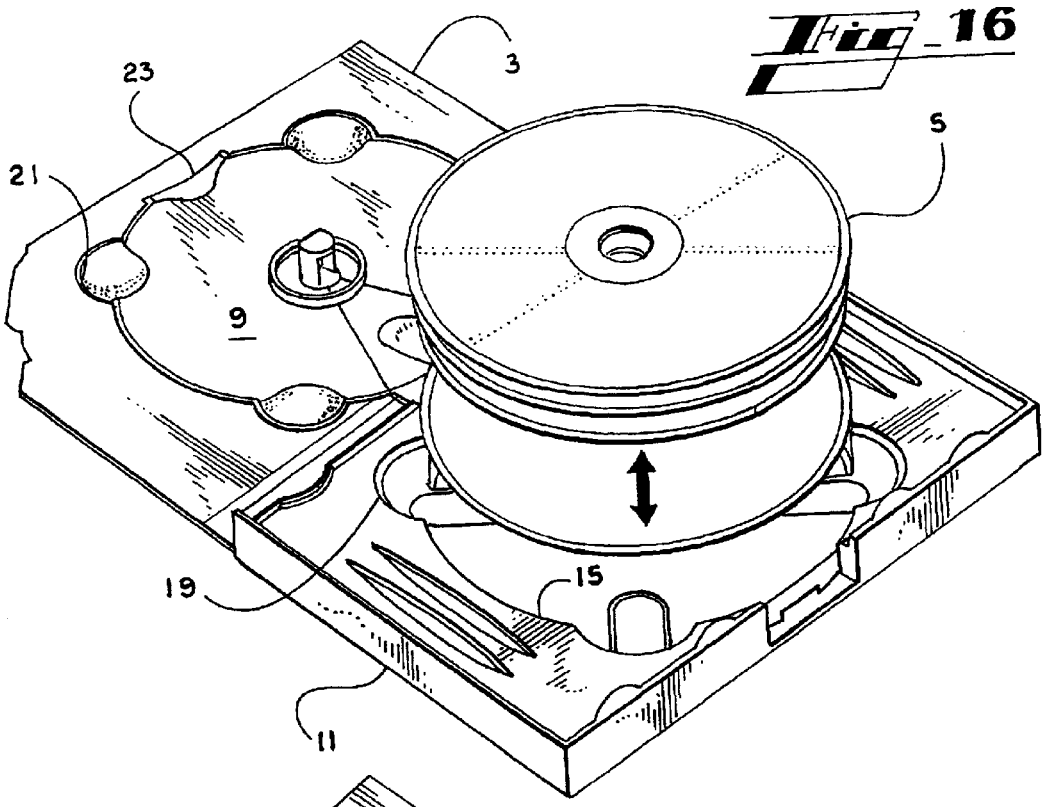
FIG. 16 shows the discs being loaded into the tray.
Figure 17:
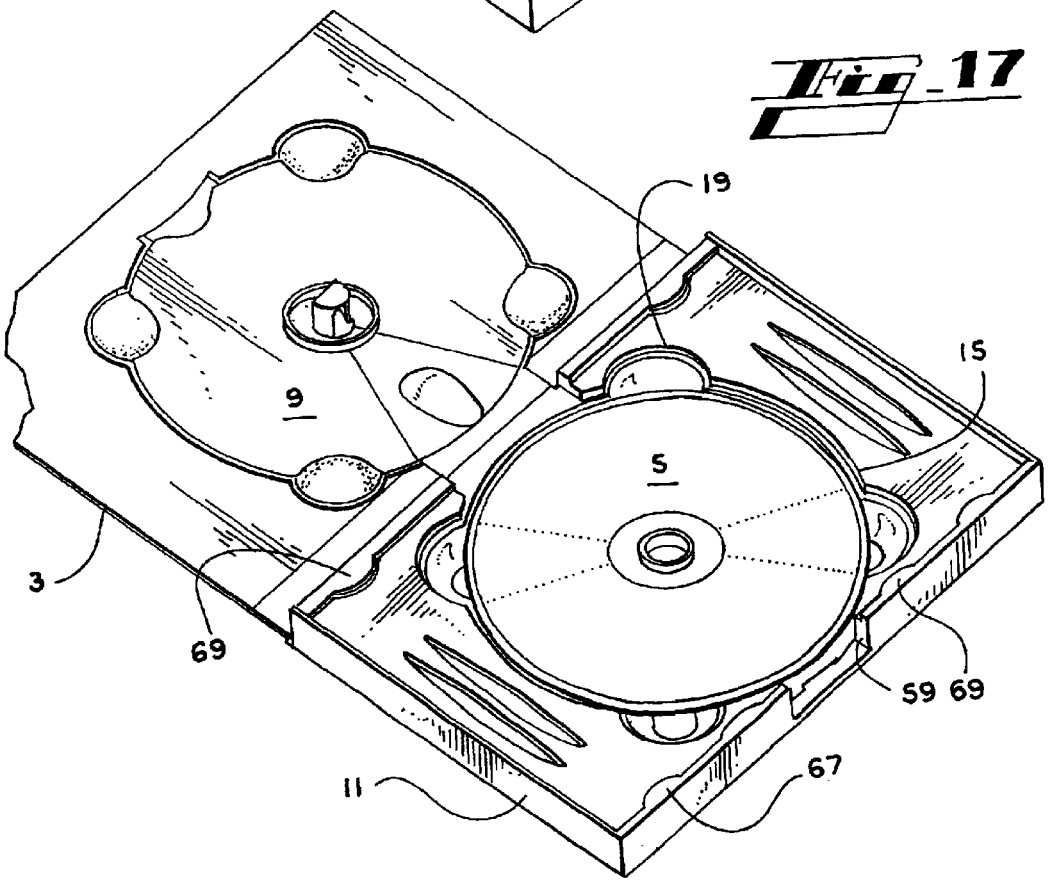
FIG. 17 shows the outer cover and the inner disc cover in open position with respect to the tray.
Figure 18:
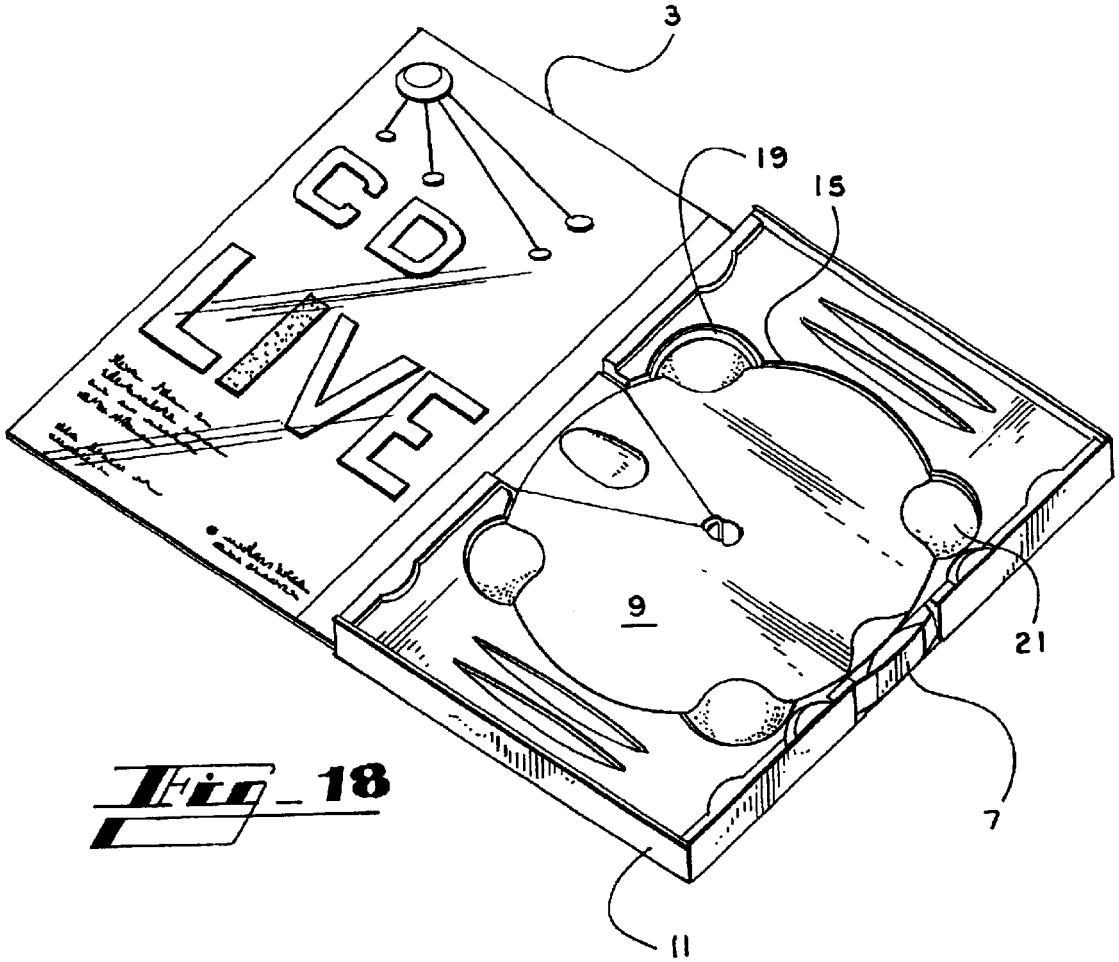
FIG. 18 shows the outer cover open, the inner disc cover closed, and the tab locked, securing the discs.
Figure 19:
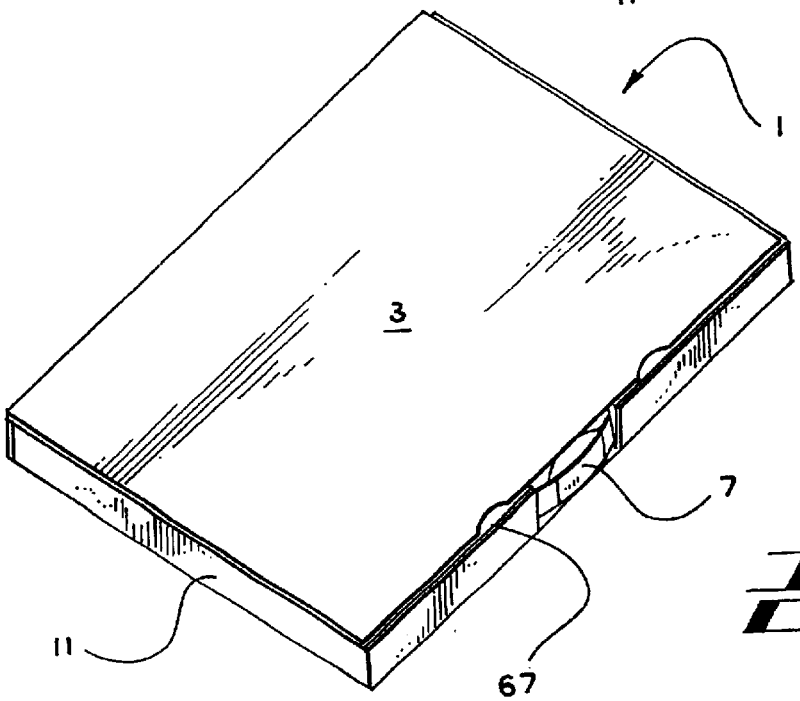
FIG. 19 shows the box closed.
Figure 20:
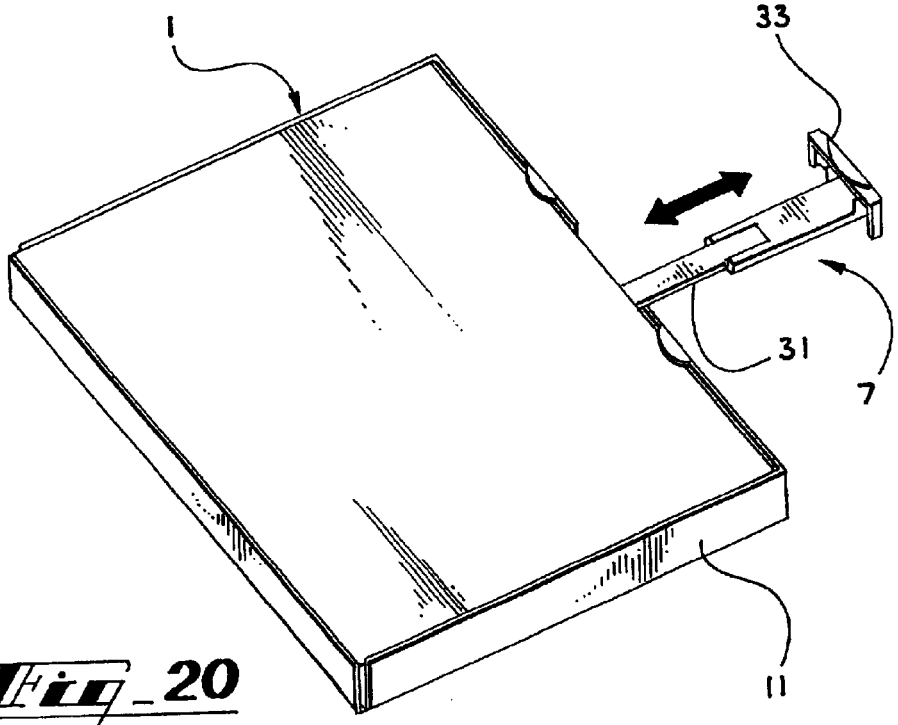
FIG. 20 shows the security tab being inserted in the box after the box is closed.

FIG. 16 shows the insertion of from one to four discs 5 in the tray 11. FIG. 17 shows the discs inserted in the tray with both the inner and outer covers open. FIG. 18 shows the security lock installed in the package. With the security lock installed, the upper cover can be opened to view graphics on the inner panel at retail. The inner disc cover locks the discs in the well that holds the discs. FIG. 19 shows the package with the outer cover closed. The forward edges of the outer cover are held closed by the tabs 67 which extend inward from an upper edge of the front rim of the tray. FIG. 20 shows the lock 7 being inserted or removed from the package.

Figure 21:
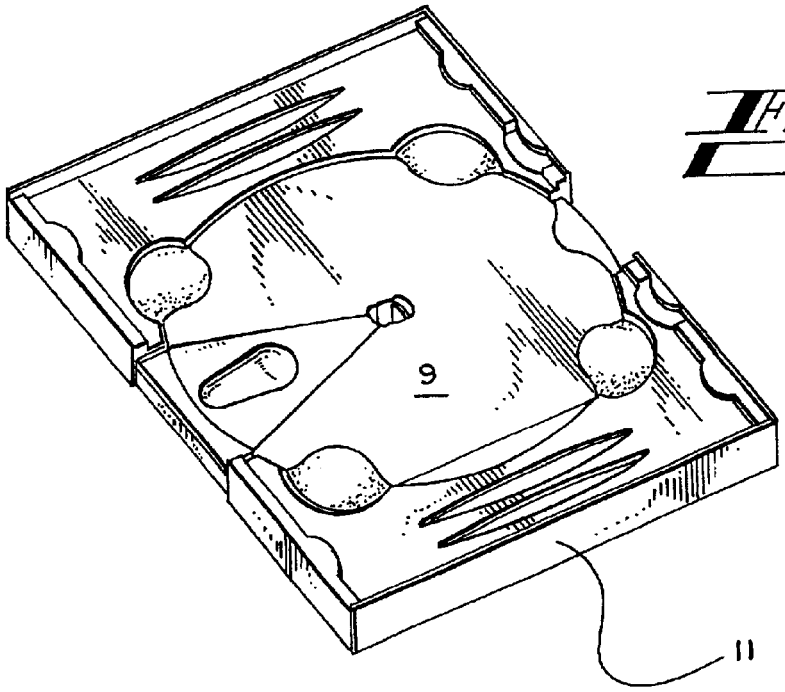
FIG. 21 shows the tray with the other cover removed
Figure 22:
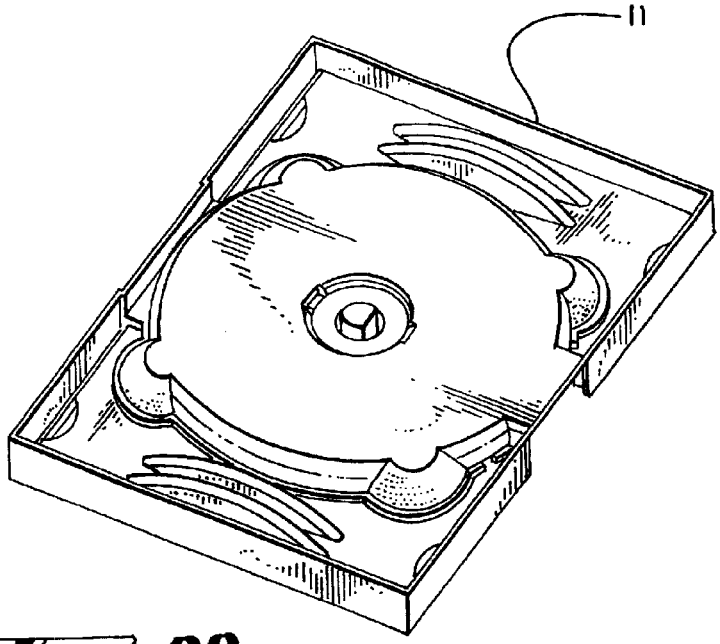
FIG. 22 shows a bottom view of the tray.
Figure 23:
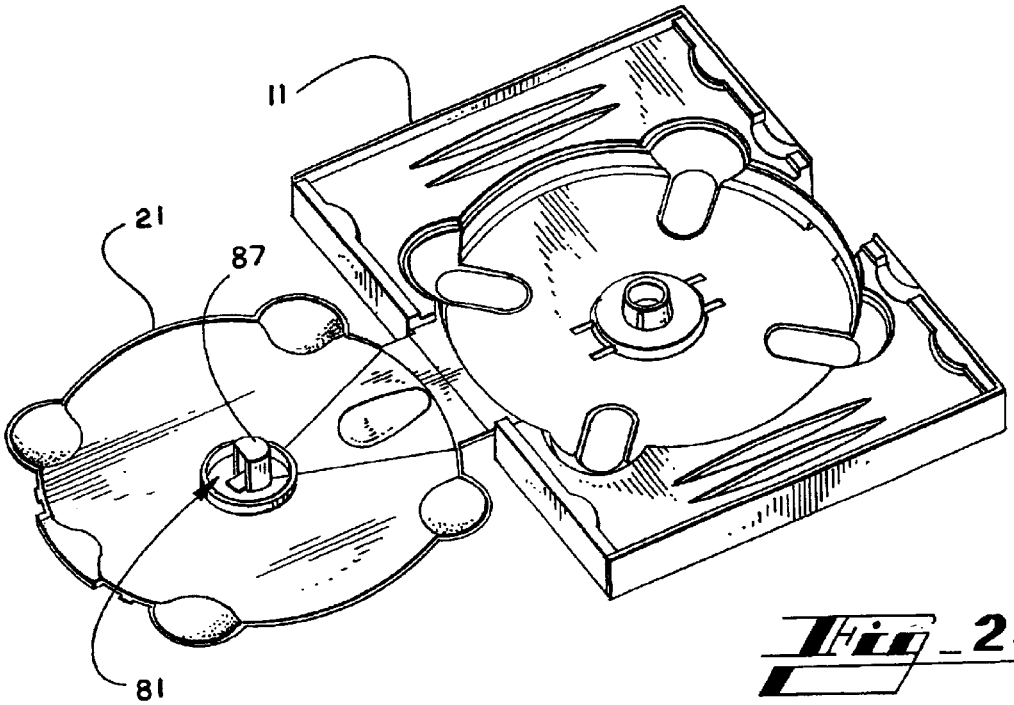
FIG. 23 shows the molded position of the tray and the inner disc cover.
Figure 24:
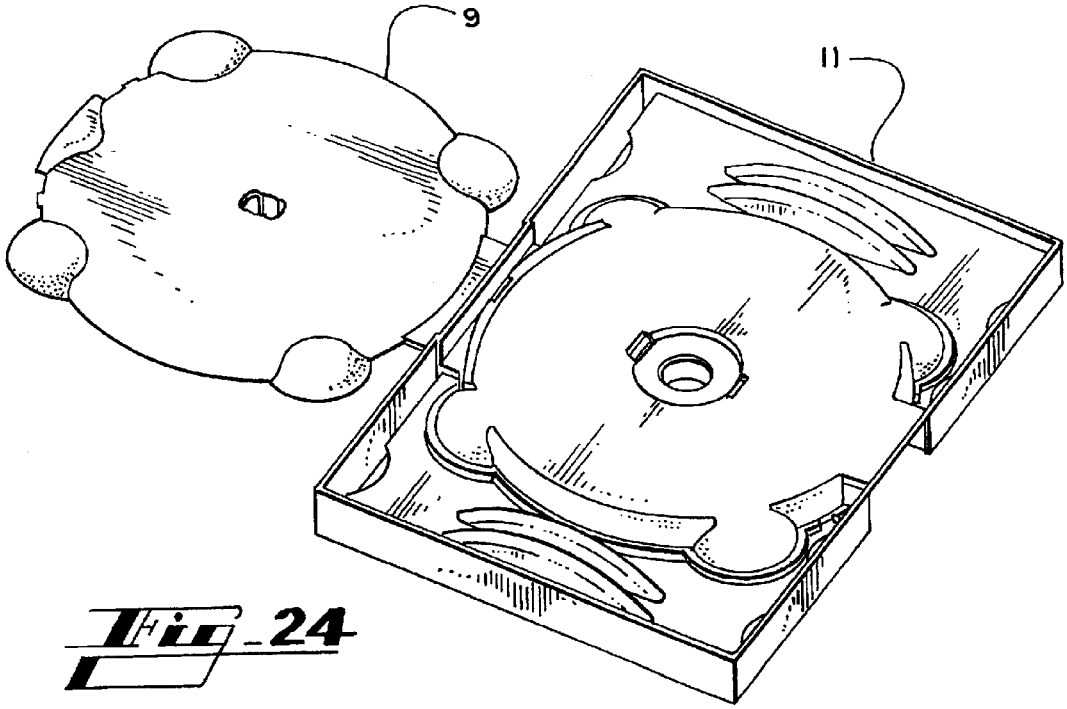
FIG. 24 shows the bottom view of the tray and molded inner disc cover in an as molded position.
Figure 25:
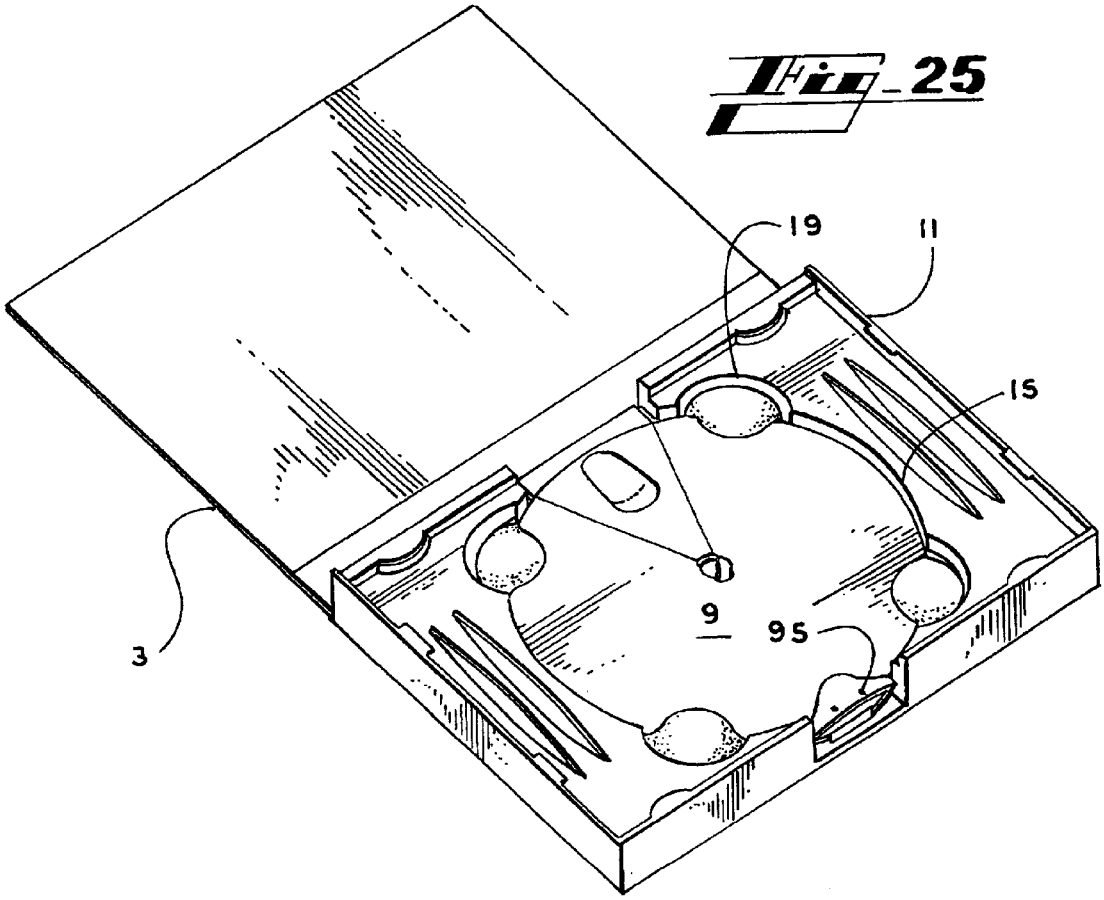
FIG. 25 shows the molded tray with the inner disc cover closed, the outer cover opened and the security tab removed.

FIG. 21 is a top view of the tray with the attached inner disc cover closed. FIG. 22 is a bottom of view of the tray with the inner disc cover closed. FIG. 23 is a top view of the tray and the inner disc cover in the molded position. FIG. 24 is a bottom view of the tray and inner disc cover in molded position. FIG. 25 is a view of the package with the outer cover opened, with the security lock removed for normal daily use.

The invention may be used in various applications for packaging information storage media discs of varying, size shape and functionality. It provides advantages in packaging in that it allows multiple discs to be accommodated in the same package. It provides advantages in storage in that the discs may be securely maintained and locked in place to prevent shifting and to prevent theft. There are also advantaged to be had in the display aspects of the packaging, as the packaging case can be opened to display the graphics and other printed information while maintaining the security of the discs so that they cannot be removed. Moreover, the security device does not consume large areas of the package facades, but rather allows for easy viewing to detect tampering. These and other benefits may be attributed to the presently claimed invention.

While the invention has been described with reference to specific embodiments, modifications and variations of the invention may be constructed without departing from the scope of the invention, which is defined in the following claims.

I claim:

1. A storage-display packaging case for housing one or more media discs comprising:

a) a case comprising an outer cover, a spine and a back cover panel;

b) a tray comprising a disc mounting hub formed thereon;

c) an inner disc cover formed to cover at least a portion of the uppermost of one or more media discs mounted on the hub, the inner disc cover being hingedly connected to the tray and having an extension engageable with the hub; and d) a security device comprising as elements thereof:

i) the inner disc cover; and ii) a locking dagger having an element thereon that is shaped to cooperate with the inner disc cover;

said locking dagger being engageable with the inner disc cover so as to prevent movement of the inner disc cover away from the hub.

2. The packaging case of claim 1 wherein the locking dagger comprises a head portion and a dagger section.

3. The packaging case of claim 2 wherein the head portion of the locking dagger further comprises a tab that overlays at least a portion of the inner disc cover when the security device is engaged.

4. The packaging case of claim 1 wherein the extension comprises lateral walls and a bridge portion extending between the lateral walls remote from the cover.

5. The packaging case of claim 1 wherein the inner disc cover further comprises a forward extension at a peripheral edge thereof.

6. The packaging case of claim 5 wherein the forward extension comprises openings sized to accommodate teeth formed on the head portion of the locking dagger.

7. The packaging case of claim 1 wherein the outer cover further comprises an extension forming one or more inner panels that may optionally be folded within the interior of the packaging case.

8. The packaging case of claim 1 wherein the outer cover and the tray are formed together as a single part.

9. The packaging case of claim 2, wherein the head portion is connected to the dagger section by a living hinge formed therebetween; and the head portion further comprises a rib formed in the head portion.

10. The packaging case of claim 2, 3 or 9 wherein the dagger section of the locking dagger is configured to overlay the tray beneath the lowermost media disc when the lock is engaged.

11. A locking system for a media packaging case having a tray that accommodates media discs on a hub, which comprises:

a) a locking dagger comprising a head portion at one end thereof and connected to a dagger section at another end thereof; the dagger section extending outward from and connected to the head portion and terminating in a remote tip; and b) an inner disc cover attached to a tray for holding one or more media storage discs, said inner disc cover comprising an extension thereof for engaging the hub;

wherein the locking system is activated by engagement of the inner disc cover with the hub, followed by engagement of the locking dagger with the inner disc cover.

12. The locking system of claim 11 wherein the tray and inner disc cover are formed as a single part.

13. The locking system of claim 11 wherein the head portion of the locking dagger further comprises locking snaps formed in the head portion.

14. The locking system of claim 13 wherein the head portion of the locking dagger further comprises a tab that overlays at least a portion of the inner disc cover when the locking system is engaged.

15. The locking system of claim 11, 12, 13 or 14 wherein the dagger section of the locking dagger is configured to overlay the tray beneath the lowermost media disc when the locking system is engaged.

16. The locking system of claim 11 wherein the inner disc cover further comprises a forward extension at a peripheral edge thereof.

17. The locking system of claim 16 wherein the forward extension comprises openings sized to accommodate teeth formed on the head portion of the locking dagger.

18. The locking system of claim 11 wherein the extension comprises lateral walls and a bridge portion extending between the lateral walls remote from the cover.

19. The locking system of claim 11 further including a severable rib formed in the head portion, said locking system being disengaged by cutting said rib.

20. A holder for mounting one or more media disks comprising:

a) a base comprising a disk mounting hub formed thereon for releasably holding one or more media disks;

b) said disk mounting hub fitting through the central aperture of said one or more media disks;

c) a cap having a portion overlapping the upper surface of the disks and a projecting portion for fitting within the disk mounting hub for preventing removal of disks therefrom; and d) a security device comprising as elements thereof:

i. the projecting portion of said cap; and ii. a locking dagger slidable beneath said one or more media disks and engageable with the projecting portion of said cap for preventing removal of said cap.

21. The holder of claim 20 wherein said disk mounting hub comprises a hollow column.

* * * * *